US005956978A

United States Patent [19]

Dorn et al.

[11] Patent Number: 5,956,978

[45] Date of Patent: Sep. 28, 1999

[54] KNITTING MACHINE

[75] Inventors: Michael Dorn, Frick; Silvan Borer, Uitikon, both of Switzerland

[73] Assignee: Textilma AG, Switzerland

[21] Appl. No.: 09/043,371

[22] PCT Filed: Oct. 4, 1996

[86] PCT No.: PCT/CH96/00349

§ 371 Date: Mar. 17, 1998

§ 102(e) Date: Mar. 17, 1998

[87] PCT Pub. No.: WO97/13908

PCT Pub. Date: Apr. 17, 1997

[30] Foreign Application Priority Data

Oct. 11, 1995 [CH] Switzerland ..... 2875/95

[51] Int. Cl.[6] ..... D04B 27/26

[52] U.S. Cl. ..... 66/207; 364/470.12

[58] Field of Search ..... 66/82 A, 207, 66/208; 364/470.12

[56] References Cited

U.S. PATENT DOCUMENTS

| | | | |
|---|---|---|---|
| 3,820,082 | 6/1974 | Bauknecht et al. | 340/470.12 |
| 5,311,751 | 5/1994 | Winter et al. | 66/207 |
| 5,375,435 | 12/1994 | Gille et al. | 66/211 |
| 5,473,913 | 12/1995 | Bogucki-land | 66/207 |
| 5,502,987 | 4/1996 | Zorini | 66/207 |
| 5,768,916 | 6/1998 | Borer | 66/207 |

FOREIGN PATENT DOCUMENTS

| | | | |
|---|---|---|---|
| 0 684 331 | 11/1995 | European Pat. Off. | 66/207 |
| 42 38 600 | 11/1992 | Germany | 66/207 |
| 42 15 716 | 11/1993 | Germany | 66/207 |

*Primary Examiner*—Andy Falik
*Attorney, Agent, or Firm*—George Pappas

[57] ABSTRACT

A knitting machine, in particular a warp knitting machine with a central control apparatus (120) containing a computer with an input device (122) for the establishing of the characteristic data of the knitted article (20) to be produced and with a central control unit (124) which is connected over a line (126) with individual drives (**16, 28, 33, 35, 63*a*, 63*b*, 63*c*, 63*d*) for aggregates (15, 22, 32 34, 44*a*, 44*b*, 44*c*, 44*d*) of the knitting machine. The knitting machine has a main drive (16) for at least one needle bar of a row of needles and a central control unit (120) with an input device (122) to establish the characteristics of the knitwear to be produced. In order to improve the control, each drive (16, 28, 33, 35, 63*a*, 63*b*, 63*c*, 63*d*) of individual components (15, 22, 32, 34, 44*a*, 44*b*, 44*c*, 44*d*) has an individual intelligent control unit (163, 283 33$_3$, 35$_3$, 63*a*$_3$, 63*c*$_3$, 63*d*$_3$) to assume and process the relevant program module of the control device (120). The drives are interconnected and synchronized via a shared reference value pulse generator line (130), in which one drive (16) is the main drive and an appropriate pulse generator (16$_4$) is the reference value pulse generator.

32 Claims, 4 Drawing Sheets

KNITTING MACHINE

TECHNICAL FIELD

The invention relates to a knitting machine, in particular a warp knitting machine with a central control apparatus containing a computer with an input device for the establishing of the characteristic data of the knitted article to be produced and with a central control unit which is connected over a line with individual drives for aggregates of the knitting machine, in which each drive has an individual, intelligent control unit for the take-over and working-out of an appertaining program module from the central control apparatus as well as, in each case, a timer for the determination of the working position of the aggregate State of the art.

BACKGROUND OF THE INVENTION

A knitting machine of the type mentioned at the outset is known from DE-A-42 38 600. This knitting machine contains a central control unit and individual intelligent control units for the individual aggregates. The individual control units are equipped in each case with a timer. The connection between the central control unit and the individual control units occurs over an external BUS. On the individual control units program modules are provided which are necessary for the particular aggregate such as, for example, shafts, throw devices, and laying bars for the knitted product to be produced. It is disadvantageous that the coordination of the single individual control units occurs over the central control unit, onto which the signals of the individual timers are forwarded, processed and given back as control signals to the individual control units. For this the central control unit contains an additional BUS-driver. Through this design the control is not only relatively complicated, but especially also limited in the rapidity of the data exchange and of the control of the aggregates.

SUMMARY OF THE INVENTION

The problem of the invention is to improve a knitting machine of the type mentioned at the outset.

This problem is solved according to the invention by providing a knitting machine, in particular a warp knitting machine with a central control apparatus containing a computer with an input device for the establishing of the characteristic data of the knitted article to be produced and with a central control unit which is connected over a line with individual drives for aggregates of the knitting machine, in which each drive has an individual, intelligent control unit for the take-over and working-out of an appertaining program module from the central control apparatus as well as, in each case, a timer for the determination of the working position of the aggregate, characterized in that the drive of an aggregate is constructed as main drive and the appertaining timer is constructed as desired-value timer, in which system the latter is connected over a desired-value timer line directly with the individual control units of all the aggregates, in which system the remaining timers are joined as auxiliary timers in each case with the appertaining drive constructed as auxiliary drive, the whole in such manner that a pattern program input on the central control apparatus is workable on the individual control units, independently from the central control unit of the central control apparatus. By the means that each drive has an individual intelligent control unit for the take-over and working-up of an appertaining program module of the control program of the central control apparatus, and the drive of an aggregate is constructed as main drive with appertaining timer as desired value timer, the drives of all the aggregates being connected with one another over a desired-value timer line, there is yielded a substantial simplification, greater flexibility and adaptability of the drives, especially of the auxiliary drives. Thereby it is possible to load the individual control units on switching-on of the knitting machine directly in each case with the appertaining program module, so that all the drives can be regulated autonomously, i.e. without communication with the central control apparatus, and therefore more rapidly than hitherto, and the drives can react more simply, more rapidly and more exactly to turning rate changes of the main drive. Thereby, too, the central control apparatus is no longer needed and is free for the input of new control programs. Therewith each program module can be adjusted individually for the individual function to be brought out, so that complicated transition cams, compensating cams and the like are not necessary. Therewith there is yielded a substantial improvement of the control of the knitting machine.

For the formation of the desired-value timer various possibilities are yielded. It is advantageous to provide as desired-value timer a signal-giver responding to the angular position of a main drive shaft.

Advantageous is the construction of the knitting machine according to which each auxiliary drive is provided with a synchronous motor. Such a synchronous motor is advantageously connected over a reducing gear with the aggregate to be driven in each case, which is, for example, a laying bar. Thereby there can be achieved high displacement forces, for example two kilopond per thread with a mean displacement of 108 mm or else with small thread forces to achieve great displacement courses as these are necessary, for example, for the full throw over the entire length of the knitting machine.

The main drive is preferably equipped with an asynchronous motor.

The knitting machine is preferably equipped with at least two laying bars which, especially by reason of their in each case own auxiliary drive, can be arranged very flexibly and in a space-saving manner. Thus it is possible for the one laying bar to provide the drive at the right end and for the other laying bar the drive at the left end, whereby a space-saving arrangement is yielded, which, moreover, is restricted only to the ends of the laying bar, so that the remaining space can be used for other components and/or the accessibility of the knitting machine.

The same advantages are yielded also for the arrangement of a full-throw device and/or of a partial-throw device. Especially advantageous there is the construction where in the circulation member is settable both for partial throws and for full throws individually, in which system the amount of the displacement can be altered without mechanical interventions by means of the individual control unit.

Especially advantageous is also a further development whereby a very efficient and optimally adjustable draw-off device is yielded, which again is very space-saving, whereby space stands available either for other components and/or the accessibility of the knitting machine is improved.

The auxiliary drives for the individual aggregates or aggregate groups make possible an individual, flexible control of the individual aggregates or aggregate groups, especially of the laying bars, as well as the attunement of the thread-laying to the knitting needle movement. Thereby the binding type, the mesh size and the force courses can be optimized, without its being necessary to reconvert the knitting machine. For knitting machines with large divisions and therewith great displacement movements substantial advantages, there, are yielded for the individual aggregate groups by means of the auxiliary drives, since, for example in a mechanical control of the laying bars the operation would have to be effected with very great expenditure.

The control according to the invention is well suited especially for coarse knitting machines, i.e. for knitting machines for coarse knitted goods, since such machines as a rule are slow-running (100 revolutions per minute) and operate with large needle divisions of, for example, one needle per two centimeters, in which long displacement and swing movements must be executed. In hitherto usual knitting machines the divisions are substantially finer, for example six needles per centimeter and the displacement strokes correspondingly smaller, at higher speeds of, for example 500 to 2000 revolutions per minute.

The concept of the invention is of great advantage especially in double needle-row knitting machines, which is very important for the practical use. Double needle-row knitting machines hitherto offered on the market have either the drive or drive elements for the swing and/or the laying bars mounted centrally in the knitting machine, whereby the goods draw-off has to be guided in a complicated manner around the drive elements and whereby, moreover, the knitted product is poorly accessible in the zone of the offtake. This is troublesome, on the one hand, in the entry of the knitted product, but also in the inspection and during the production as well as in the drawing-off of the knitted goods.

The auxiliary drives of the invention for the laying bars, in contrast, by reason of the concept of the individual drives can be mounted on both sides of the knitting machine, so that no drives or drive elements extend in a troublesome manner into the draw-off zone of the knitted product. Therewith the knitted product is easily accessible for the entry in the starting of the knitting machine, which improves the operating safety of the knitting machine and also facilitates the inspection and the draw-off of the knitted goods. Especially the simplification of the goods draw-off is especially essential, since thereby the draw-off rollers can be brought up very close to the knitting place, which improves the operating security, i.e. the precise mesh formation and therewith the mesh quality.

BRIEF DESCRIPTION OF THE DRAWINGS

Examples of execution of the knitting machine of the invention are described in detail in the following with the aid of schematic drawings. In these.

DETAILED DESCRIPTION OF THE PREFERRED EMBODIMENTS

Figure 1:
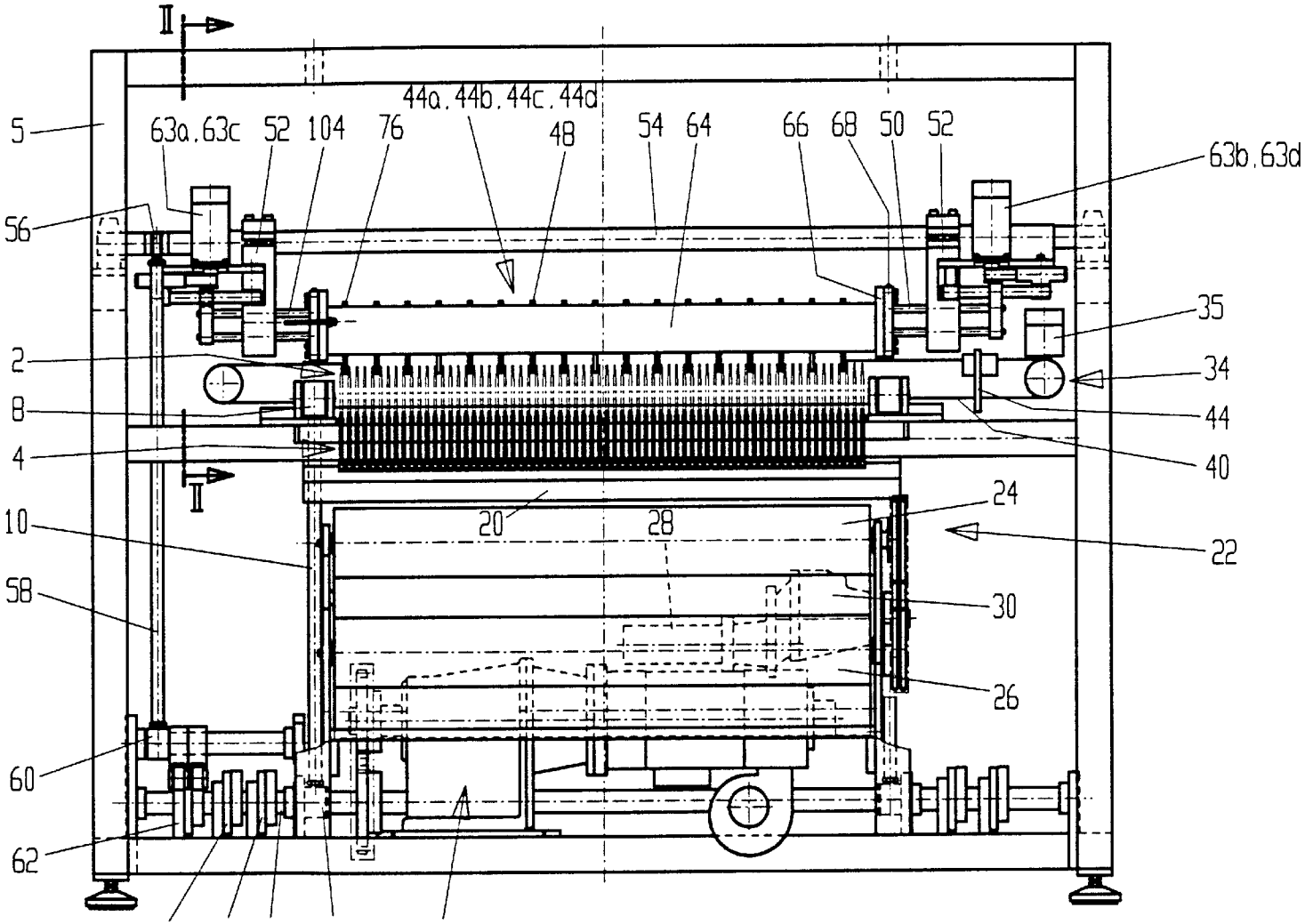
FIG. 1 shows a warp knitting machine in a view of the long side.
Figure 2:
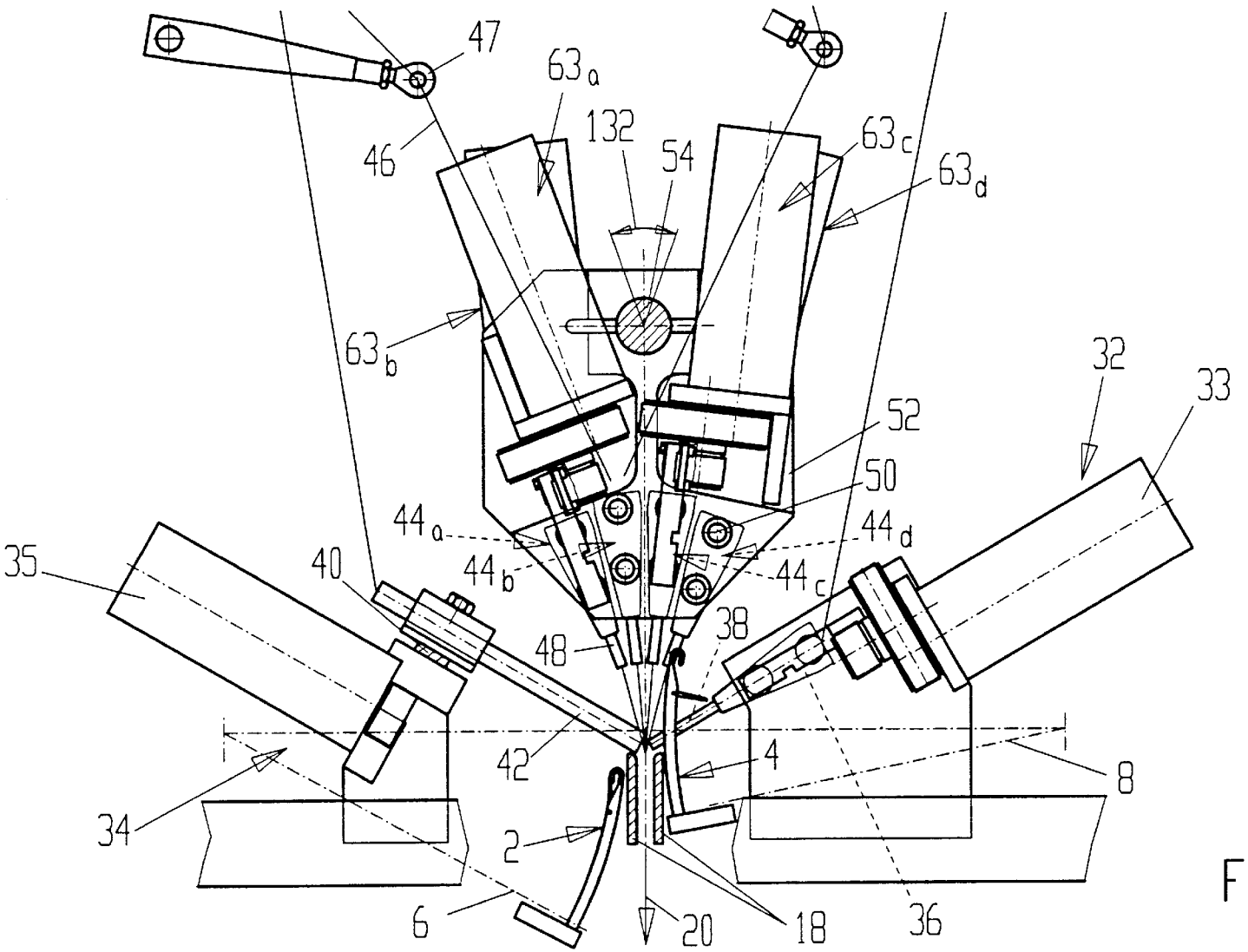
FIG. 2 shows the knitting zone of the warp knitting machine of FIG. 1 in the section II—II of FIG. 1 and on a larger scale.

As preferred example of execution of a knitting machine according to the invention there is represented in FIGS. 1 and 2 a double needle-row double-rib loom machine, i.e. a warp knitting machine with two knitting needle rows 2, 4, which are arranged swinging up and down and are drivable in a known manner by means of needle bars on swing levers 6, 8 born in the machine frame 5. Thus these oscillating levers 6, 8 are driven, for example, over coupling rods 10 which cooperate with oscillation (swing) levers 12 which cooperate on their free end with cam plates 14 on a main shaft 15 which is driven from a main drive 16. The knitting needle rows 2, 4 are arranged on both sides of knock-off rails 18, between which the knitted article 20 is drawn off by means of a draw-off device 22. The latter consists of two draw-off rollers 24, 26 which are driven from an auxiliary drive 28, and a contact-pressure roller 30.

To each knitting needle row 2, 4 there assigned a partial-throw device 32 with an auxiliary drive 33 or a full-throw device 34 with an auxiliary drive 35. The partial-throw device 32 (omitted in FIG. 1 in the interest of clarity) has a laying bar 36 and thread guides 38, which in each case displace only over one section of the knitting needle rows 4. The full-throw device 34 contains a circulation member 40 driven by means of the auxiliary drive 35 13. back and forth over the entire knitting needle row 2, said circulation member 40 being constructed as a toothed belt, to which there is fastened a thread guide 42 for the execution of the full throw.

Over the knitting needle rows 2, 4 there are arranged four further lying bars 44*a*, 44*b*, 44*c*, 44*d* with thread guides 48 for the feeding-in of warp threads 46 over upper guide members 47. The laying bars 44*a*, 44*b*, 44*c*, 44*d* contain on both sides two parallel carrier bars 50, by means of which they are provided shiftably in longitudinal direction in rocking arms 52, which on their part are fastened to a swingable shaft 54, which is provided in the machine frame 5. The shaft 54 is provided in a manner known per se with a drive lever 56, on which a coupling rod is articulated, which is connected with a further lever 60 swingable in the machine frame, which lever 60 cooperates with a cam plate 62 on the main shaft 15 driven from the main drive 16. The laying bars 36, 44*a*, 44*b*, 44*c*, 44*d* are constructed at least essentially identical, it being possible, however, to arrange auxiliary 35, 63*a*, 63*b*, 63*c*, 63*d* serving for shifting on longitudinal direction, on arbitrary sides, for example alternating from laying bar to laying bar, once on the right and once on the left end. The laying bars can be differently constructed; preferably, however, they are constructed fundamentally alike, in which system individual laying bars or all of them can be equipped with at least one auxiliary laying bar.

Figure 3:
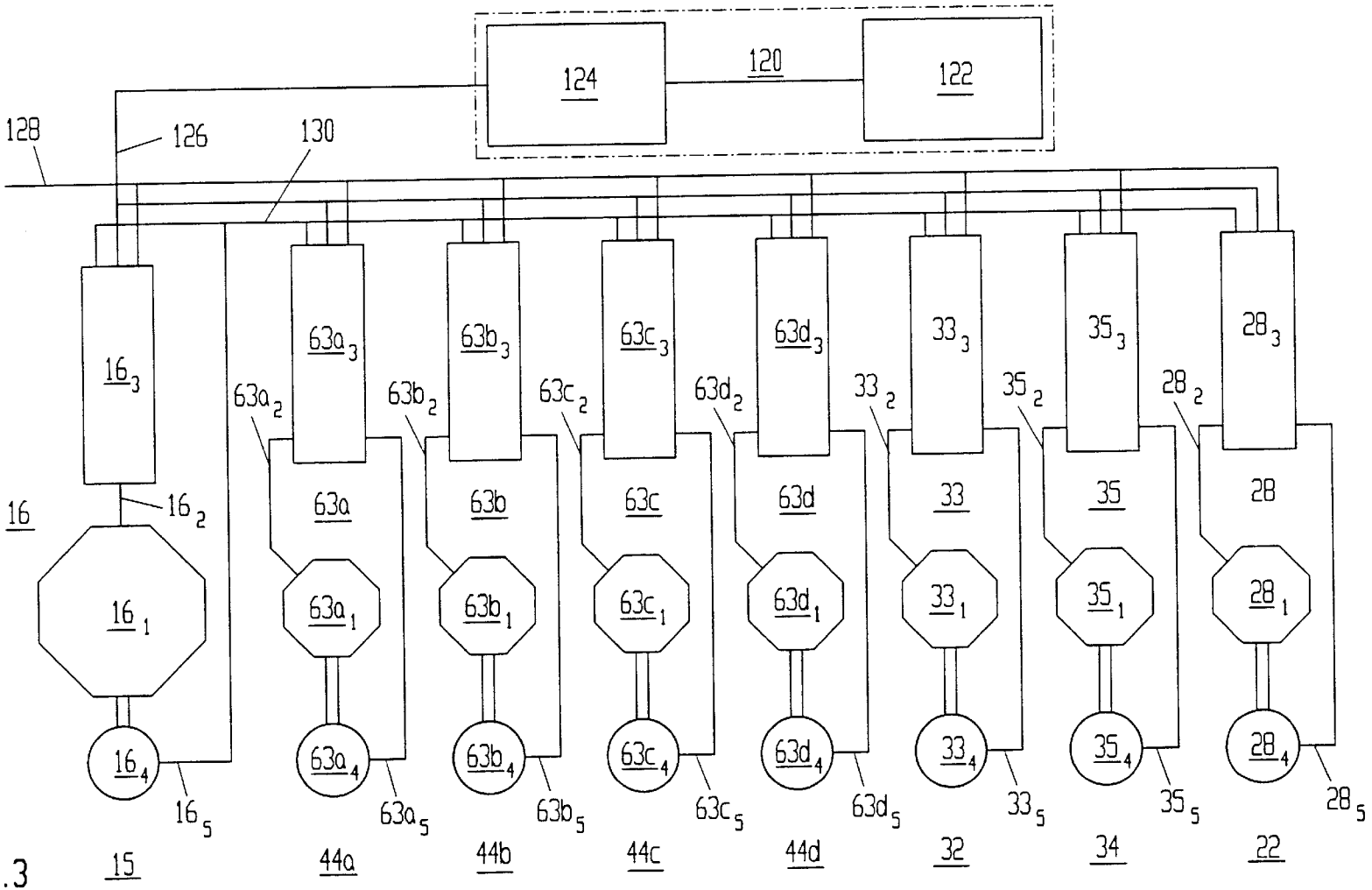
FIG. 3 shows a block circuit diagram of the control of the warp knitting machine.

FIG. 3 shows a block circuit diagram for the control of the above-described warp knitting machine with its aggregates. The warp knitting machine contains a central control apparatus 120 with an input device 122, on which, for example by means of a keyboard, a diskette-running mechanism or the like, the characteristic data of the desired pattern for the knitted article to be manufactured can be input. A connected central control unit 124 processes the data and conducts them over a communication line 126 to the individual parallel-wired drives, i.e. to the main drive 16, the auxiliary drives 63*a*, 63*b*, 63*c*, 63*d* for the laying bars 44*a*, 44*b*, 44*c*, 44*d*, the auxiliary drive 33 for the partial throw device 32, the auxiliary drive 35 for the full-throw device 34 and the auxiliary drive 28 for the draw-off device 22. All the drives are connected to a feed line 128 for the energy supply. All the drives are autonomously and identically constructed, so that the indices for the respective reference numbers signify in each case the same parts, and namely:

Index 1: Motor

Index 2: Line

Index 3: Individual control unit with computer

Index 4: Timer

Index 5: Timer line.

For the main drive 16 there is yielded, therefore, the following construction. A motor $\mathbf{16}_1$ is connected over a line $\mathbf{16}_2$ with an individual control unit $\mathbf{16}_3$ containing a computer, which control unit $\mathbf{16}_3$ autonomously processes a program module fed in over the communication line 126 from the central control apparatus 120. For this there is connected to the motor $\mathbf{16}_1$ a timer $\mathbf{16}_4$ which responds to the angular positions of the main drive shaft 15 of the main drive 16 and is connected over a timer line $\mathbf{16}_5$ with the individual control unit $\mathbf{16}_3$. In the present example the timer $\mathbf{16}_4$ of the main drive serves as desired value for the auxiliary drives, so that the timer line $\mathbf{16}_5$ of the main drive is connected over a desired-value timer line 130 in parallel with all the auxiliary drives 63*a*, 63*b*, 63*c*, 63*d*, 33, 35, 28 and serves for the coordination of the working of the program modules to the auxiliary drives on the basis of the desired value prescribed by the timer $\mathbf{16}_4$ of the main drive 16. The auxiliary timers $\mathbf{63}a_4$, $\mathbf{63}b_4$, $\mathbf{63}c_4$ $\mathbf{63}d_4$, $\mathbf{33}_4$, $\mathbf{35}_4$, $\mathbf{28}_4$ of the various auxiliary drives are connected over corresponding timer lines $\mathbf{63}a_5$, $\mathbf{63}b_5$, $\mathbf{63}c_5$, $\mathbf{63}d_5$, $\mathbf{33}_5$, $\mathbf{35}_5$, $\mathbf{28}_5$ with the respective individual control units $\mathbf{63}a_3\mathbf{3}$, $\mathbf{63}b_3$, $\mathbf{63}c_3$, $\mathbf{63}d_3$, $\mathbf{33}_3$ $\mathbf{35}_3$, $\mathbf{28}_3$ and serve the purpose of detecting the actual state of each auxiliary drive, which is then compared by the respective individual control unit of the auxiliary drive with the desired value of the main drive and correspondingly adapted. The individual program modules are loaded in the switching-on of the warp knitting machine or in the starting of the program course of the central control apparatus 120 to the individual control unit $\mathbf{16}_3$ of the main drive 16 and the individual control units $\mathbf{63}a_3$, $\mathbf{63}b_3$, $\mathbf{63}c_3$, $\mathbf{63}d_3$, $\mathbf{33}_3$, $\mathbf{35}_3$, $\mathbf{28}_3$ of the individual auxiliary drives 63*a*, 63*b*, 63*c*, 63*d*, 33, 35, 28 and there self-sufficiently processed. Thereby each drive can be controlled with equal entitlement and therewith more rapidly. No communication is necessary between the central control apparatus and the other individual control units of the other drives. The central control apparatus 120 is, furthermore, free after the discharging of the program modules in order to save the characteristic data for the production of another knitted article.

Auxiliary gears 63*a*, 63*b*, 63*c*, 63*d*, 33, 35 of the laying bars 44*a*, 44*b*, 44*c*, 44*d*, of the partial-throw device 32 and of the full-throw device 34 operate absolutely synchronously, the auxiliary drive 28 of the draw-off device 22 can be driven with a positively or negatively deviating drive-turning rate, in order to make it possible to adjust the draw-off device to the properties of the particular knitted article being produced. A warp knitting machine of the present type has, for example, the following data:

| | |
|---|---|
| Operating turning rate | 10 to 120 rpm. |
| Creep speed | 0.1 to 5 rpm. |
| Draw-off mesh width | 4 to 50 mm/rev. |
| Lowering of draw-off | 0 to 100% |
| Needle division | 14, 18, 22 mm |
| Length of production | 1 to ∞ m |

Figure 4:
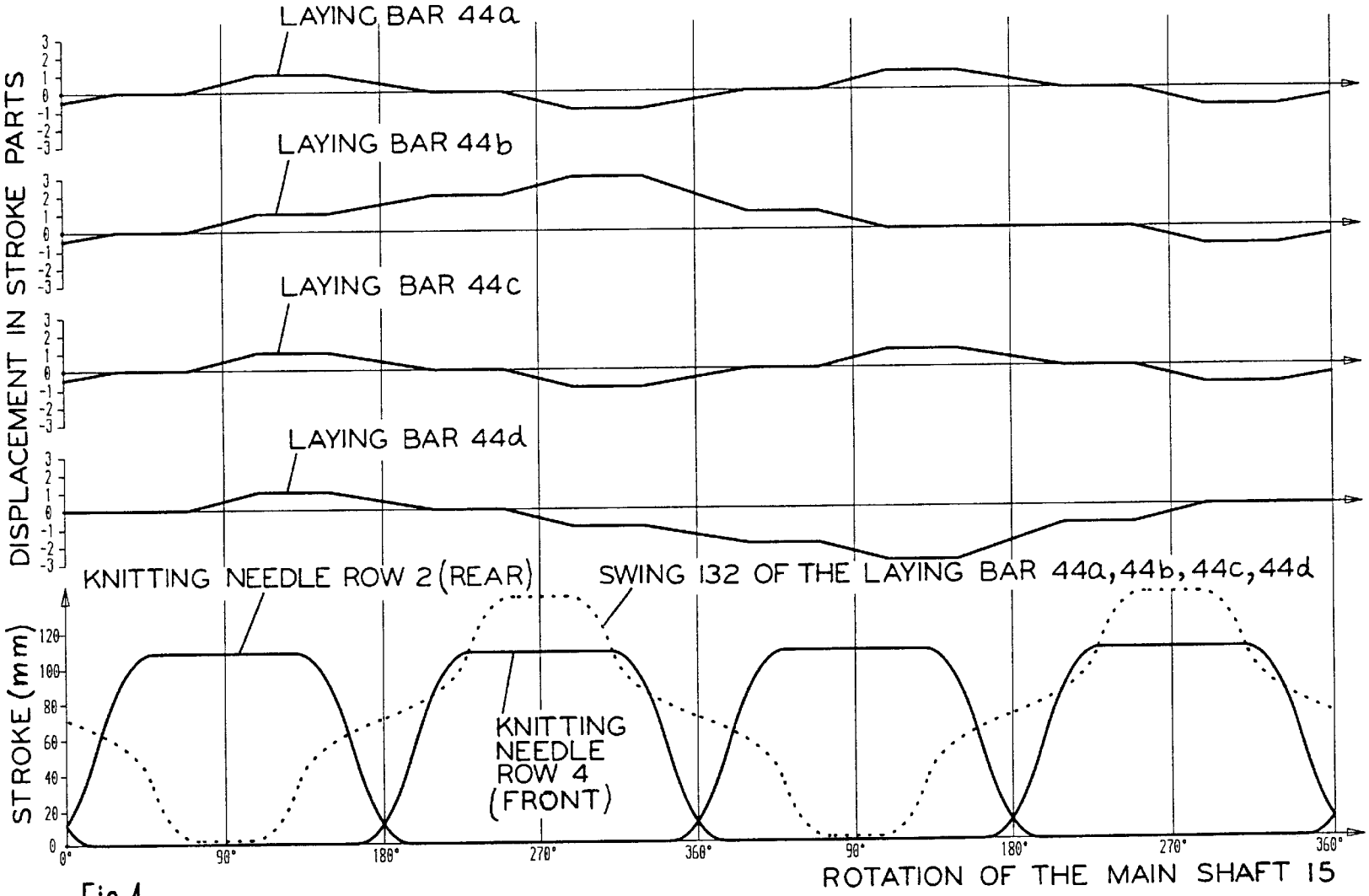
FIG. 4 shows a run-off plan for the cooperation of the aggregates in the production of a knitted article.

For each knitted article to be manufactured and for the entire pattern repeat there is stored in the central control apparatus 120, for example, a specific instruction list (computer program), which is not represented here in detail. Such an instruction list is loaded at the starting of the knitting machine as program module in the individual control units of the individual auxiliary drive and run off there, in which operation the coordination of the individual auxiliary drives with the main drive 16 is ensured by the desired value pulse over the desired-value timer line 130. FIG. 4 shows in a run-off plan the interaction of the rear needle bar with the rear needle row 2, of the front needle bar with the front needle row 4, of the swinging movement 132, i.e. of the swing (traverse) of the laying bars 44*a*, 44*b*, 44*c*, 44*d* as well as displacement of the laying bars 44*a*,44*b*, 44*c*, 44*d* in dependence on the rotary movement of the main shaft 15 for two revolutions of the same. The displacement of the laying bars is given in partial strokes of plus/minus units, in which 1 unit in each case corresponds to a needle division.

The warp knitting machine represented is very well-suited for the production of coarse knitted goods with, for example, coarse threads up to 4800 tex. Thus, by means of the warp knitting machine, for example, nets and mats can be produced for the most diverse purposes, such as, for example, nets for climbing walls in playgrounds, safety nets of the most diverse type, mats and the like in each case for the most diverse purposes of use.

LIST OF REFERENCE NUMBERS

2 Knitting needle row
4 Knitting needle row
5 Machine frame
6 Rocking lever
8 Rocking lever
10 Coupling rod
12 Rocking lever
14 Cam plate
15 Main shaft
16 Main drive
18 Knocking-over bars
20 Knitted article
22 draw-off device
24 Draw-off roller
26 Draw-off roller
28 Auxiliary drive
30 Contact-pressure roller
32 Partial-throw device
33 Auxiliary drive
34 Full-throw device
35 Auxiliary drive
36 Laying bar
38 Thread guide
40 Circulation member
42 Thread guide
44*a* Laying bar
44*b* Laying bar
44*c* Laying bar
44*d* Laying bar
46 Warp thread
47 Guide member
48 Thread guide
50 Supporting bar
52 Rocker arm
54 Shaft
56 Drive lever
58 Coupling rod
60 Lever
62 Cam plate
63*a* Auxiliary drive
63*b* Auxiliary drive
63*c* Auxiliary drive
63*d* Auxiliary drive
120 Central control apparatus
122 Input device
124 Central control unit
126 Communication line

128 Feed line
130 Timer line
132 Rotating motion (swing)

What is claimed is:

1. Knitting machine, in particular a warp knitting machine with a central control apparatus containing a computer with an input device for the establishing of the characteristic data of the knitted article to be produced and with a central control unit which is connected over a line with individual drives for aggregates of the knitting machine, in which each drive has an individual, intelligent control unit for the take-over and working-out of an appertaining program module from the central control apparatus as well as, a timer for each aggregate for the determination of the working position of the aggregate, characterized in that the drive of one aggregate is constructed as a main drive and the appertaining, timer is constructed as a desired-value timer, wherein the latter is connected over a desired-value timer line directly with the individual control units of all the aggregates, wherein the remaining timers are joined as auxiliary timers in each case with the appertaining drive constructed as an auxiliary drive, wherein a pattern program input on the central control apparatus is workable on the individual control units independently from the central control unit of the central control apparatus.

2. Knitting machine according to claim 1, characterized in that the desired-value timer is constructed as a signal giver responding to the angular position of a main shaft of the main drive.

3. Knitting machine according to claim 2, characterized in that the motor of each auxiliary drive is constructed as a synchronous motor.

4. Knitting machine according to claim 2, characterized in that the motor of the main drive is constructed as an asynchronous motor.

5. Knitting machine according to claim 2, characterized in that it has at least two laying bars each with an auxiliary drive of its own, in which the auxiliary drives of the laying bars are arranged.

6. Knitting machine according to claim 2, characterized in that it has a fill-throw device with an auxiliary drive of its own running over the entire length of a knitting needle row.

7. Knitting machine according to claim 2, characterized in that it has at least one partial-throw device with an auxiliary drive of its own cooperating with a knitting needle row.

8. Knitting machine according to claim 2, characterized in that it has a draw-off device with an auxiliary drive of its own, the draw-off rate of which is adjustable.

9. Knitting machine according to claim 1, characterized in that the motor of each auxiliary drive is constructed as a synchronous motor.

10. Knitting machine according to claim 9, characterized in that the motor of the main drive is constructed as an asynchronous motor.

11. Knitting machine according to claim 9, characterized in that it has at least two laying bars each with an auxiliary drive of its own, in which the auxiliary drives of the laying bars are arranged.

12. Knitting machine according to claim 9, characterized in that it has a full-throw device with an auxiliary drive of its own running over the entire length of a knitting needle row.

13. Knitting machine according to claim 9, characterized in that it has at least one partial-throw device with an auxiliary drive of its own cooperating with a knitting needle row.

14. Knitting machine according to claim 9, characterized in that it has a draw-off device with an auxiliary drive of its own, the draw-off rate of which is adjustable.

15. Knitting machine according to claim 1, characterized in that the motor of the main drive is constructed as an asynchronous motor.

16. Knitting machine according to claim 15, characterized in that it has at least two laying bars each with an auxiliary drive of its own, in which the auxiliary drives of the laying bars are arranged.

17. Knitting machine according to claim 15, characterized in that it has a full-throw device with an auxiliary drive of its own running over the entire length of a knitting needle row.

18. Knitting machine according to claim 15, characterized in that it has at least one partial-throw device with an auxiliary drive of its own cooperating with a knitting needle row.

19. Knitting machine according to claim 15, characterized in that it has a draw-off device with an auxiliary drive of its own, the draw-off rate of which is adjustable.

20. Knitting machine according to claim 1, characterized in that it has at least two laying bars each with an auxiliary drive of its own.

21. Knitting machine according to claim 20, characterized in that it has a full-throw device with an auxiliary drive of its own running over the entire length of a knitting needle row.

22. Knitting machine according to claim 20, characterized in that it has at least one partial-throw device with an auxiliary drive of its own cooperating with a knitting needle row.

23. Knitting machine according to claim 20, characterized in that it has a draw-off device with an auxiliary drive of its own, the draw-off rate of which is adjustable.

24. Knitting machine according claim 1, characterized in that it has a full-throw device with an auxiliary drive of its own running over the entire length of the knitting needle row.

25. Knitting machine according to claim 24, characterized in that the throw device has a circulation member circulating over the entire working width, driven by the auxiliary drive, on which a thread guide is arranged.

26. Knitting machine according to claim 25, characterized in that it has a draw-off device with an auxiliary drive of its own, the draw-off rate of which is adjustable.

27. Knitting machine according to claim 24, characterized in that it has at least one partial-throw device with an auxiliary drive of its own cooperating with a knitting needle row.

28. Knitting machine according to claim 24, characterized in that it has a draw-off device with an auxiliary drive of its own, the draw-off rate of which is adjustable.

29. Knitting machine according to claim 1, characterized in that it has at least one partial-throw device with an auxiliary drive of its own cooperating, with a knitting needle row.

30. Knitting machine according to claim 29, characterized in that the throw device has a circulation member circulating over an entire working width, driven by the auxiliary drive, on which a thread guide is arranged.

31. Knitting machine according to claim 29, characterized in that it has a draw-off device with an auxiliary drive of its own, the draw-off rate of which is adjustable.

32. Knitting machine according to claim 1, characterized in that it has a draw-off device with an auxiliary drive of its own, the draw-off rate of which is adjustable.

* * * * *

UNITED STATES PATENT AND TRADEMARK OFFICE

CERTIFICATE OF CORRECTION

PATENT NO. : 5,956,978

DATED : September 28, 1999

INVENTOR(S) : Michael Dorn, Silvan Borer

It is certified that error appears in the above-identified patent and that said Letters Patent is hereby corrected as shown below: On the title page: Item [54] and Column 1, line 3, Change "KNITTING MACHINE" to --WARP KNITTING MACHINE WITH CENTRAL CONTROL APPARATUS--.

In the Abstract, line 15, change "163" to --$16_3$--.

In the Abstract, line 15, change "283" to --$28_3$--.

Column 4, line 19, delete "13".

Column 7, Claim 6, line 2, change "fill" to --full--.

Signed and Sealed this

Twenty-fifth Day of April, 2000

*Attest:*

*Attesting Officer*

Q. TODD DICKINSON

*Director of Patents and Trademarks*